United States Patent [19]

Renau et al.

[11] 4,274,098

[45] Jun. 16, 1981

[54] LOSS-FREE SCANNING ANTENNA

[75] Inventors: Jacques Renau, Culver City; James W. Curtis, Riverside; Donald S. Nicholson; Frank L. Hennessey, both of Los Angeles, all of Calif.

[73] Assignee: The United States of America as represented by the Secretary of the Air Force, Washington, D.C.

[21] Appl. No.: 128,343

[22] Filed: Mar. 7, 1980

[51] Int. Cl.[3] ..... H01Q 19/19

[52] U.S. Cl. ..... 343/781 CA; 343/839; 343/840

[58] Field of Search ..... 343/761, 781 P, 781 CA, 343/839, 840

[56] References Cited

U.S. PATENT DOCUMENTS

| | | | |
|---|---|---|---|
| 2,976,533 | 3/1961 | Salisbury | 343/755 |
| 3,641,577 | 2/1972 | Tocquec | 343/754 |
| 4,044,361 | 8/1977 | Yokoi et al. | 343/754 |
| 4,062,018 | 12/1977 | Yokoi et al. | 343/761 |

*Primary Examiner*—Eli Lieberman

*Attorney, Agent, or Firm*—Donald J. Singer; Arsen Tashjian

[57] ABSTRACT

A system for, and a method of, scanning a collimated beam of electromagnetic radiation with a very large primary reflector of an antenna system without loss (i.e., with zero phase error) and without moving the primary reflector. The system is a two dimensional scan, loss-free, Cassegrain antenna system which comprises a stationary, parabolic-shaped, primary reflector, and a smaller, movable, parabolic-shaped subreflector, and also a movable, plane wave, electromagnetic radiation beam source interposed between the two reflectors. It is shown that, without moving the primary reflector, the beam can be scanned over wide angles with no phase error in the plane of scan, provided that the source and the subreflector are rotated about the focal point of the antenna in a specific manner. A unique angular relationship between the source and the subreflector is required for each scan angle, and is taught. The method includes the step of using this antenna system in scanning the beam from the primary reflector, without any phase error and without moving the primary reflector.

3 Claims, 1 Drawing Figure

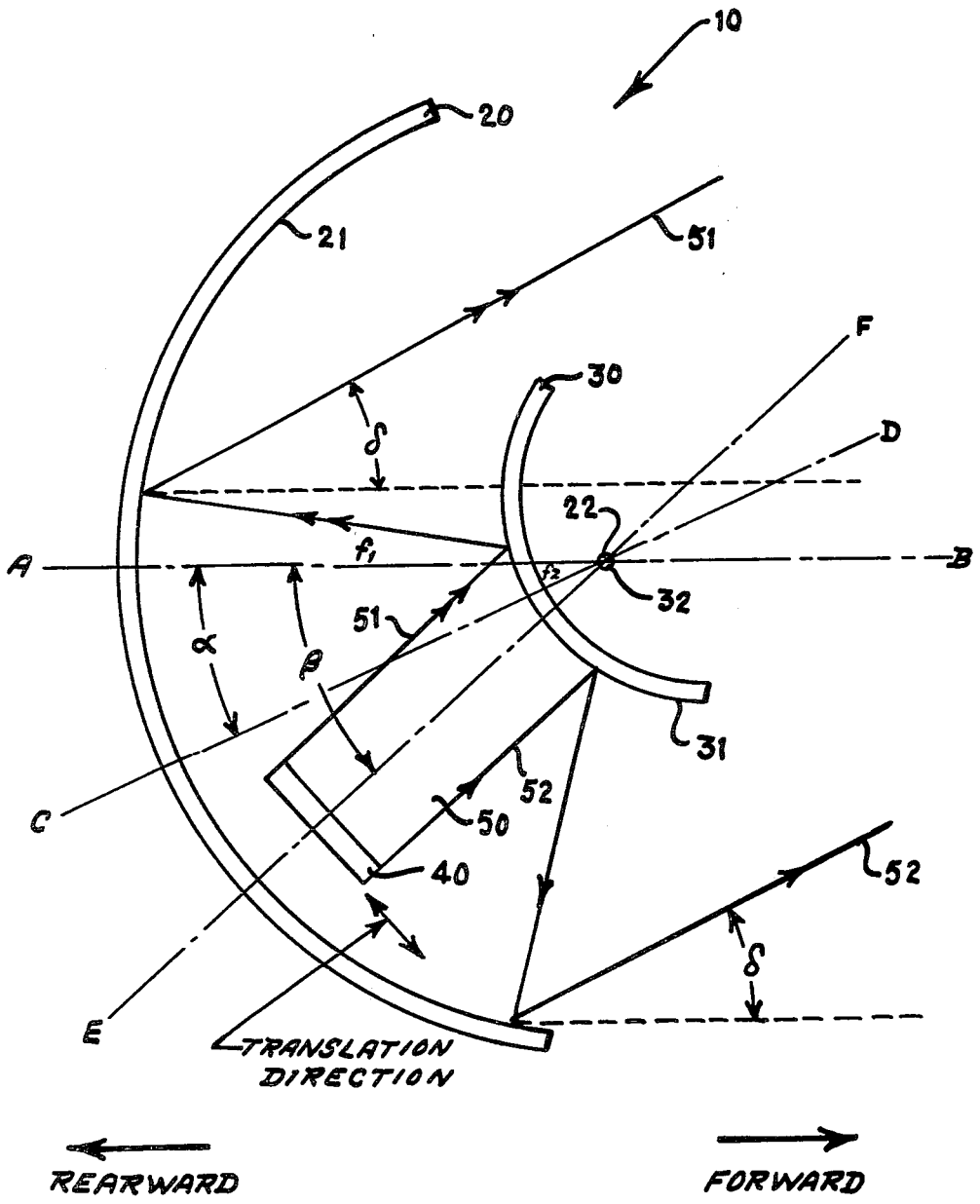
10
20
21
51
F
30
D
δ
22
A
f1
f2
B
32
51
α
β
31
52
C
50
40
52
δ
E
TRANSLATION DIRECTION
REARWARD
FORWARD

LOSS-FREE SCANNING ANTENNA

STATEMENT OF GOVERNMENT INTEREST

The invention described herein may be manufactured and used by or for the Government for governmental purposes without the payment of any royalty thereon.

BACKGROUND OF THE INVENTION

This invention relates to the electromagnetic wave beam scanning art and, more particularly, to a unique apparatus (i.e., an antenna reflector scanning system of the Cassegrain type) for, and a novel method of, scanning many beamwidths off axis with no phase errors, and without spillover, and without moving the very large primary reflector of the system.

A continuing need has existed in the art for an apparatus and/or a method by which an electromagetic beam can be scanned by, and with, a very large reflector with minimum loss.

We have fulfilled this need with our reflector antenna system and with our novel method of scanning the beam. By doing so, we have significantly advanced the state-of-the-art.

SUMMARY OF THE INVENTION

The invention pertains specifically to a two dimensional scan, loss-free (i.e., no phase error), Cassegrain antenna system, and to a method of scanning a collimated beam of electromagnetic radiation with, by, and from a very large primary reflector of the antenna system, without loss and without moving the primary reflector.

Accordingly, an object of this invention is to provide the structure of a preferred embodiment of above-described unique antenna system.

Obviously, another object of this invention is to teach the steps of the above-described novel method.

These objects, as well as other equally important and related objects, of this invention will become readily apparent after a consideration of the description of our inventive system and method, coupled with reference to the drawing.

DESCRIPTION OF THE DRAWING

The drawing is a side elevation view, in simplified schematic form, of a preferred embodiment of our inventive antenna system, and concurrently also shows the result of the performance of the steps of our inventive method.

DESCRIPTION OF THE PREFERRED EMBODIMENT

With reference to the drawing, therein is shown, in simplified schematic form, a preferred embodiment of our inventive antenna system and the principal components thereof.

In the most basic and generic structural form, the preferred embodiment 10 of our inventive two dimensional scan, loss-free, Cassegrain antenna system comprises two confocal parabolic surfaces (such, for example, as a larger, stationary, primary reflector 20, and a smaller, movable, secondary reflector 30 hereinafter referred to as the "subreflector") fed by a movable collimated source 40 of electromagnetic radiation 50 that is interposed between the primary reflector 20 and the subreflector 30.

More specifically, the larger, stationary, primary reflector 20 is in the geometric form of a parabolic (i.e., two dimensional) surface having a front surface 21, a focal point 22, a focal length $f_1$, and an axis A-B passing through the focal point 22.

Also, and more specifically, the movable subreflector 30 also is in the geometric form of a parabolic (i.e., two dimensional) surface having a rear surface 31 and a focal length $f_2$, with the subreflector 30 being confocal with, forward of, and facing away from the front surface 21 of the primary reflector 20, and with the movable subreflector 30 having an axis C-D passing through the focal point 22 of the primary reflector 20 (and also the focal point 32 of the subreflector, which are coincident), at which point 22, 32 this axis C-D intersects the axis A-B of the primary reflector, and these intersecting axes A-B and C-D define an angle of $\alpha$ rotation of the movable subreflector 30. It is here to be noted that the focal length $f_2$ of the movable subreflector 30 and the focal length $f_1$ of the stationary primary reflector 20 are related to each other in accordance with the (ratio) expression:

$$(f_1/f_2)>1$$

Further, and more specifically, the movable collimated source 40 of electromagnetic radiation 50 is a plane wave one which emits a beam 50 (which, in turn, is defined by edge rays 51 and 52) and has an axis E-F that passes through the focal point 22 of the stationary reflector 20 (i.e., the confocal point 22, 32) at which point this axis E-F intersects the axis A-B of the primary reflector 20 (and the axis C-D of the subreflector 30), and the intersecting axes A-B and E-F define an angle of rotation $\beta$ of the movable source 40. It is here to be noted that while, the source 40 is interposed between the primary reflector 20 and the movable subreflector 30, it is simultaneously also disposed such that all rays (such as representative rays 51 and 52) of the collimated beam 50 that are emitted by the source 40 impinge upon, and are reflected by, the rear surface 31 of the movable reflector 30 and, in turn, impinge upon, and are reflected by, the front surface 21 of the stationary primary reflector 20 at a constant preselected, scan angle $\delta$, where the scan angle is determined by use of the equation:

$$\delta=\beta-2\alpha$$

where:

$\delta$=constant scan angle $\beta$=angle of rotation of the movable source 40

$\alpha$=angle of rotation of the movable subreflector 30.

It is also to be noted that, as a practical consideration, the maximum value of $\beta$ is limited and should not exceed 90°. Therefore, as will be shown later herein, the maximum scan angle $\delta$ is approximately:

$$\delta < \frac{90^\circ}{2\frac{f_1}{f_2}-1}$$

MANNER OF OPERATION AND USE OF THE PREFERRED EMBODIMENT

The manner of operation and use of the preferred embodiment 10 of our inventive antenna system can be easily ascertained by any person of ordinary skill in the art from the foregoing description, coupled with reference to the drawings.

As a related matter, it will be of interest to those of ordinary skill in the art, that we have subjected our Cassegrain antenna system (which, in essence as described and shown, comprises two confocal parabolic reflectors 20 and 30 fed by a collimated source 40) to a two dimensional ray tracing analysis. As a result, we have found that a relationship exists between source 40 rotation angle $\beta$ and the subreflector 30 rotation angle $\alpha$, such that all rays (such as 51 and 52) emanating from the collimated source 40 are reflected off the large parabola 20 at a constant (scan) angle $\delta$. This relationship was deterrmined to be $$\beta-\alpha=\alpha+\delta$$

This condition then reduces the general expressions obtained for the scan angle $\delta$ of the emerging rays from the large aperture to $$\sin(\beta-\alpha)=(f_1/f_2)\sin\delta$$

which is applicable to all rays independent of their location with respect to the feed axis E-F.

It is here to be noted that a small translation (as shown in the drawing), in addition to the rotation, of the collimated source 40 will keep the rays reflected from the subreflector 30 centered on the large parabola 20, such that the entire reflector 20 will be used at all scan angles.

Again with reference to the above equations, the expression $f_1/f_2>1$ is the ratio of the focal lengths of the two parabolic reflectors 20 and 30.

The simultaneous solution of the above two equations lead to $$\alpha=\sin^{-1}[((f_1/f_2))\sin\delta]-\delta$$

and $$\beta=2\sin^{-1}[((f_1/f_2))\sin\delta]-\delta$$

In other words, we have ascertained that there is a unique combination of $\alpha$ and $\beta$ which produces a perfect linear phase front for every value of $\delta$. Moreover, the maximum value of $\beta$ will be limited by practical consideration and should not exceed about 90°. Therefore, the maximum scan angle is approximately $$\delta<\frac{90^\circ}{2\frac{f_1}{f_2}-1}$$

It is to be noted that the above conditions for implementing a two dimensional, loss-free (i.e., zero phase error). Cassegrain antenna system are purely geometrical and are independent of the wavelength. The conditions can be applied to two dimensional scanning systems at microwave, infrared, or optical frequencies. The maximum scan angle (which can be many hundreds of beamwidths for apertures that are very large in terms of a wavelength) will be limited by the smallest acceptable ratio of the focal lengths $f_1$ and $f_2$ (i.e., the smaller this ratio, the larger the blockage loss implied), and the physically permissible source rotation angle about the focal point. The source must be rotated through an angle roughly twice the scan angle multiplied by $f_1/f_2$.

DESCRIPTION OF THE INVENTIVE METHOD

With regard to our inventive method of scanning a collimated beam of electromagnetic radiation with, by, and from a primary reflector of a two dimensional Cassegrain antenna system, without loss (i.e., with no phase error) and without moving the primary reflector, said method comprises basically two steps which, in part, already have been inferentially set out hereinbefore.

The first step comprises using our inventive antenna system 10, which has already been shown and described, for performing the scanning.

The second, and last, step comprises maintaining (while scanning with our system 10) the scan angle $\delta$ at a constant preselected value that is determined by use of the equations:

$$\delta=\beta-2\alpha \text{ and } \sin(\beta-\alpha)=(f_1/f_2)\sin\delta$$

where:

$\delta$=constant scan angle $\beta$=angle of rotation of the movable source, such as 40

$\alpha$=angle of rotation of the movable subreflector, such as 30.

CONCLUSION

It is abundantly clear from all of the foregoing, and from the drawing, that the stated desired objects, as well as related objects, of our invention have been achieved.

It is to be noted that, although there have been shown and described the fundamental features of our invention, as applied to a preferred embodiment and as set forth in an inventive method, it is to be understood that various embodiments, variations, adaptations, substitutions, additions, omissions and the like may occur to, and can be made by, those of ordinary skill in the art, without departing from the spirit of our invention. For example, our discovery with regard to a two dimensional system can be extended to a three dimensional system by employing parabolic cylinder reflectors where each reflector is generated by translating the parabolas in the drawing perpendicular to the paper. The line source in the drawing is also translated perpendicular to the paper to generate a plane providing the required plane wave source. This approach preserves the loss-free characteristics for a single plane scan. Another three dimensional embodiment of this invention is achieved by spinning the parabolas (such as 20 and 30) about their axes (such as A-B and C-D, respectively), i.e., by using paraboloidal surfaces. In this latter case, scanning off axis in one plane, and obeying the geometrical requirements on source and subreflector tilt that we have set out herein, the phase front, in planes other than the scan plane, is degraded by the effects of astigmatism and maximum degradation occurs in the plane that is orthogonal to the plane of the scan.

What is claimed is:

1. A two dimensional scan, loss-free, Cassegrain antenna system, comprising:

a. a stationary primary reflector in the geometric form of a parabolic surface having a front surface, a focal point, a focal length ($f_1$), and an axis passing through said focal point;

b. a movable subreflector in the geometric form of a parabolic surface having a rear surface and a focal length ($f_2$), with said subreflector being smaller than, confocal with, forward of, and facing away from said front surface of said stationary primary reflector, and with said movable subreflector having an axis passing through said focal point of said stationary primary reflector whereat this axis intersects said stationary primary reflector axis and these said intersecting axes define an angle of rotation ($\alpha$) of said movable subreflector, and wherein said focal length ($f_2$) of said movable subreflector and said focal length ($f_1$) of said stationary primary reflector are related to each other in accordance with the ratio expression:

$$(f_1/f_2)>1;$$

c. and, a plane wave, movable, electromagnetic radiation source emitting a collimated beam and having an axis passing through said focal point of said stationary primary reflector whereat this axis intersects said stationary primary reflector axis and these intersecting axes define an angle of rotation ($\beta$) of said movable source, with said source interposed between said stationary primary reflector and said movable subreflector, and with said source simultaneously disposed such that all rays of said collimated beam emitted by said source impinge upon, and are reflected by, said rear surface of said movable subreflector and, in turn, impinge upon, and are reflected by, said front surface of said stationary primary reflector at a constant, preselected, scan angle ($\delta$), wherein said scan angle is determined by use of the equations $$\delta=\beta-2\alpha \text{ and } \sin(\beta-\alpha)=(f_1/f_2)\sin\delta$$

where:

$\delta$=constant scan angle $\beta$=angle of rotation of said movable source $\alpha$=angle of rotation of said movable subreflector;

whereby a relationship is established among the angles $\delta$, $\beta$ and $\alpha$; and whereby said collimated electromagnetic radiation beam emitted by said source can be scanned, without loss, by said stationary primary reflector at a constant, preselected, scan angle without moving said primary reflector, and by rotating said source and said subreflector about said focal point of said primary reflector, while maintaining said relationship established by said equation.

2. A two dimenstional scan, loss-free, Cassegrain antenna system, as set forth in claim 1 wherein said constant, preselected, scan angle ($\delta$) does not exceed 90° and when, concurrently, said scan angle is approximately of the value of the expression:

$$\delta < \frac{90^\circ}{2\frac{f_1}{f_2}-1}.$$

3. A method of scanning a collimated beam of electromagnetic radiation with and from a primary reflector of a two dimensional antenna system, without loss and without moving said primary reflector, comprising the steps of:

a. using a two-dimensional Cassegrain antenna system for said scanning, wherein said antenna system includes:

said primary reflector in the geometric form of a parabolic surface having a front surface, a focal point, a focal length ($f_1$), and an axis passing through said focal point;

a movable subreflector in the geometric form of a parabolic surface having a rear surface, and a focal length ($f_2$), with said subreflector being smaller than, confocal with, forward of, and facing away from said front surface of said primary reflector, and with said movable subreflector having an axis passing through said focal point of said primary reflector whereat this axis intersects said primary reflector axis and these said intersecting axes define an angle of rotation ($\alpha$) of said movable subreflector, and wherein said focal length ($f_2$) of said movable subreflector and said focal length ($f_1$) of said primary reflector are related to each other in accordance with the ratio expression:

$$(f_1/f_2)>1;$$

and, a plane wave, movable electromagnetic radiation source emitting said collimated beam and having an axis passing through said focal point of said primary reflector whereat this axis intersects said primary reflector axis and these said intersecting axes define an angle of rotation ($\beta$) of said movable source, with said source interposed between said primary reflector and said movable subreflector, and with said source simultaneously disposed such that all rays of said collimated beam emitted by said source impinge upon, and are reflected by, said rear surface of said movable subreflector, and in turn, impinge upon, and are reflected by, said front surface of said primary reflector at a scan angle ($\delta$);

b. and, while scanning, maintaining said scan angle ($\delta$) at a constant preselected value, wherein said value of said scan angle is determined by use of the equation:

$$\delta=\beta-2\alpha$$

where:

$\delta$=constant scan angle $\beta$=angle of rotation of said movable source $\alpha$=angle of rotation of said movable subreflector.

* * * * *